United States Patent [19]

Akkerman

[11] 4,297,088

[45] Oct. 27, 1981

[54] PUMP ASSEMBLY COMPRISING GAS SPRING MEANS

[75] Inventor: Neil H. Akkerman, Kingwood, Tex.

[73] Assignee: Baker International Corporation, Orange, Calif.

[21] Appl. No.: 73,335

[22] Filed: Sep. 7, 1979

[51] Int. Cl.[3] ..... F04B 47/08

[52] U.S. Cl. ..... 417/378; 417/402

[58] Field of Search ..... 417/377, 378, 402

[56] References Cited

U.S. PATENT DOCUMENTS

| | | | |
|---|---|---|---|
| 1,946,723 | 2/1934 | Thompson | 417/378 |
| 2,180,366 | 11/1939 | Reichert | 417/378 |
| 2,384,173 | 9/1945 | Johnston | 417/377 |
| 2,562,584 | 7/1951 | Soberg | 417/378 |
| 4,013,385 | 3/1977 | Peterson | 417/377 |

*Primary Examiner*—Leonard E. Smith

*Attorney, Agent, or Firm*—William C. Norvell, Jr.

[57] ABSTRACT

A pressure actuated, rodless pump for pumping fluid preferably from a well through a tubing string comprises a chamber and a check valved movable piston which define a pump cavity, the chamber having a check valved outlet to the tubing string on the cavity side of the piston and a fluid inlet on the other side of the piston. The piston is connected to a spring assembly by a pull rod. The spring assembly includes a cylinder having an elastomeric bladder separating a gas filled chamber from an upper fluid chamber which is separated from a lower fluid chamber by a wall having a fluid passageway formed therein. The lower fluid chamber encloses a stationary piston and both the lower and upper fluid chambers are in fluid communication with the tubing string through a charge valve. Cyclic pressure applied to the fluid in the tubing string forces the cylinder and movable piston downwardly to draw fluid into the pump cavity and to force fluid from the lower fluid chamber into the upper fluid chamber to compress the gas. Alternating with the cyclic pressure, the compressed gas expands forcing fluid from the upper to the lower fluid cavity to move the cylinder and the movable piston upwardly and release fluid from the pump cavity to the tubing. The charged valve functions during the pressure cycles to replace fluid lost from the lower fluid chamber past the stationary piston.

28 Claims, 3 Drawing Figures

PUMP ASSEMBLY COMPRISING GAS SPRING MEANS

CROSS-REFERENCE TO RELATED APPLICATIONS

This application is related in subject matter to co-pending application Ser. No. 069,209, filed Aug. 23, 1979, entitled "Apparatus For Pumping Fluid From A Well Through A Tubing String", and co-pending application Ser. No. 073,395, filed Sept. 7, 1979, entitled "Rodless Pump Comprising Reference Pressure Means" with each being assigned to the same assignee as this application.

BACKGROUND OF THE INVENTION

1. Field of the Invention

The present invention relates generally to rodless pumps and in particular to a rodless pump comprising a gas spring.

2. Description of the Prior Art

Presently, low pressure, non-flowing oil wells account for over 90% of the oil wells in the United States. There are various means available for pumping these non-flowing oil wells. The most common of these pump means is the sucker rod type subsurface pump. Other types of pumps include electrical and hydraulic actuated subsurface pumps. One problem which is common to each of these subsurface pumps is that they require a separate energy transmission path for supplying the actuating energy to the pump.

Although sucker rod type pumps are not the most energy efficient, they are probably the most reliable. However, sucker rod failures are still a major problem, as studies have shown that a sucker rod fails an average of once every two years. These failures result in significant repair and maintenance costs.

There have been several attempts to provide a rodless subsurface pump system which does not require a separate energy transmission path for activating the pump. This type of pump system typically includes a surface unit which is connected to the subsurface pump by a single fluid conduit. The surface unit activates the subsurface pump by applying pressure to the fluid in the conduit to compress a spring means in the pump and displace a slidable piston to draw fluid from the well into a pump chamber. When the surface unit releases the fluid pressure, the spring means of the subsurface pump will displace the piston and lift the fluid in the pump chamber into the fluid conduit. Such systems are disclosed in U.S. Pat. Nos. 2,058,455; 2,123,139; 2,126,880 and 2,508,609.

However, these pressure activated subsurface pump systems have some inherent problems. When fluid pressure is applied to the fluid conduit, the actual energy applied to the system is much greater than the energy supplied to the subsurface pump. Since thousands of feet typically separate the surface unit and the subsurface pump, considerable work is done compressing the fluid in the conduit, ballooning the conduit, and moving fluid to compress the subsurface pump spring. In these systems, considerably more energy is consumed in compression and ballooning than is used to lift fluid. Thus, these systems are energy inefficient.

There are also several problems associated with these subsurface pumps. Typically, it has been desirous to provide a subsurface pump having a relatively long stroke length such that more fluid could be produced for a given amount of energy input. However, early subsurface pumps utilized strong helical compression springs as a means for lifting the fluid into the fluid conduit. These springs severely limited the maximum stroke length which could be attained.

Other subsurface pumps, such as the one disclosed in U.S. Pat. No. 4,013,385, utilize an inert gas pressurized chamber which functions as the spring means. When pressure is applied to the fluid conduit, a piston will compress the gas within the chamber and, when the fluid pressure is relieved, the gas will expand to lift fluid into the conduit. However, in this type of subsurface pump, it is difficult to maintain an effective seal between the gas chamber and the associated fluid.

SUMMARY OF THE INVENTION

The present invention relates to a fluid pressure actuated, rodless pump for pumping fluid through a conduit, such as a tubing string in a well. A piston chamber is connected to the lower end of the tubing. The chamber has a fluid inlet and a check valved outlet to the tubing. A piston is slidably movable in the chamber and defines a pump cavity with the chamber between a check valve in the piston and the check valved outlet.

The piston is connected to a cylinder by a pull rod. The cylinder includes an elastomeric bladder separating a gas filled chamber from an upper fluid chamber which is separated from a lower fluid chamber by a wall. A fluid passageway is formed in the wall and a charge valve connects the fluid chambers with the tubing. The lower fluid chamber encloses a stationary piston. The gas filled and the upper and lower fluid chambers function to eliminate any significant compressional forces on the pull rod thereby permitting an increased stroke and pumping capacity.

The upper end of the tubing is connected to a means for cyclically applying pressure to the fluid in the tubing. The pressurized fluid forces the cylinder and the movable piston downwardly to draw fluid into the pump chamber. At the same time, fluid is forced from the lower to the upper fluid chamber to compress the gas in the gas filled chamber. Alternating with the cyclic pressure, the gas expands to force fluid from the upper to the lower chamber to move the cylinder and the piston upwardly and release fluid from the pump cavity to the tubing.

During the cycles of applied pressure, the charge valve functions to replace any fluid lost from the lower fluid chamber past the stationary piston when tubing pressure is at its maximum, the charge valve equalizes the pressure in the upper and lower fluid chambers with the fluid pressure in the tubing. The pressurized fluid in the upper fluid chamber also militates against the leakage of gas through the elastomeric bladder.

DESCRIPTION OF THE PREFERRED EMBODIMENTS

Figure 1:
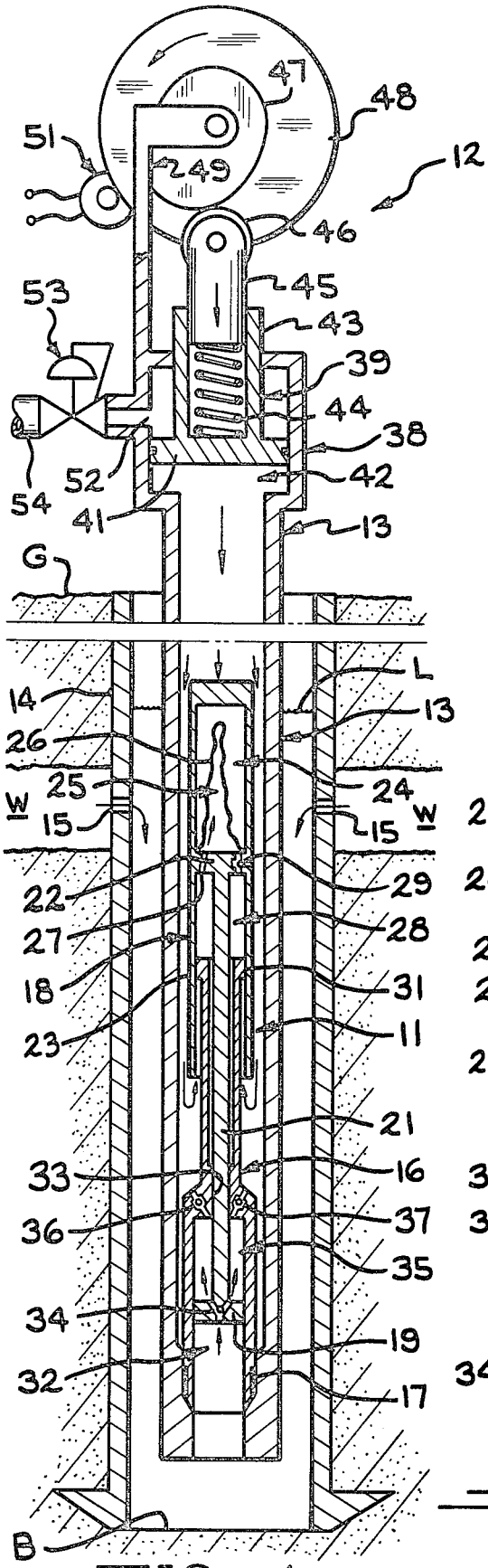
FIG. 1 is a schematic diagram of a rodless pump system according to the present invention shown during a down stroke.
Figure 2:
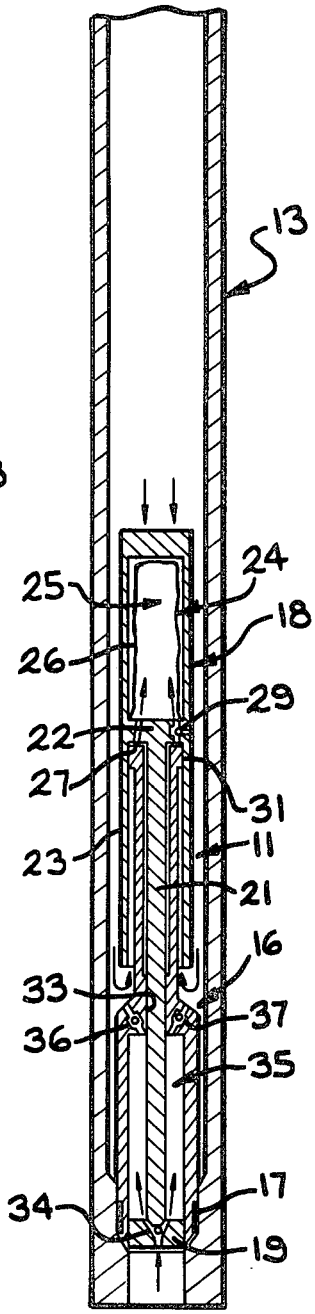
FIG. 2 is a schematic diagram of the rodless pump of FIG. 1 shown at the bottom of its stroke.
Figure 3:
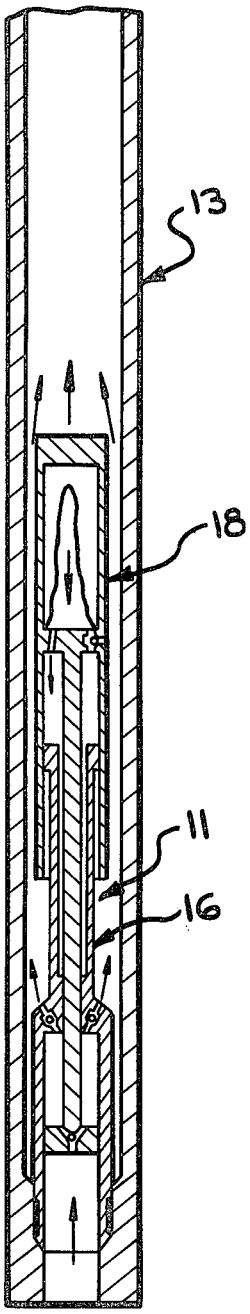
FIG. 3 is a schematic diagram of the rodless pump of FIG. 1 shown during an up stroke.

Referring to FIGS. 1, 2 and 3, there is shown in schematic form a fluid pressure actuated subsurface pump 11 according to the present invention. The subsurface pump 11, as shown in FIG. 1, is connected to a surface unit 12 by a tubing string 13. The surface unit 12 functions to cyclically apply pressure to the fluid in the tubing string 13 to actuate the subsurface pump 11. In addition to actuating the subsurface pump 11, the surface unit 12 includes means for converting potential energy which is stored as compression forces in the tubing string into an energy form suitable for re-applying fluid pressure to actuate the pump on the next cycle. As will be discussed, FIGS. 1, 2 and 3 each show the relative positions of the elements at a particular point in the pumping cycle of the subsurface pump 11.

The subsurface pump 11 is mounted within the tubing string 13 which extends to the top of the well G of a previously drilled bore hole B. A casing or other conduit 14 in inserted into the bore hole B to prevent the walls of the bore hole B from collapsing. The casing 14 has ports 15 formed in the side walls thereof to permit fluid to flow from a well production zone W into the casing 14 such that a fluid annulus having a level L surrounds the tubing string 13.

The subsurface pump 11 includes a pump chamber assembly 16 having a lower end securely attached to a seating nipple 17 mounted in the lower end of the tubing string 13. The nipple 17 can be a standard type commonly used for rod pump installation. Thus, the subsurface pump 11 can replace the rod pump in a standard rod pump system without pulling the tubing string 13 to install special seating nipples.

The pump 11 includes a gas spring assembly 18 which is slidable with respect to the pump chamber assembly 16. The spring assembly 18 includes a piston 19 which is connected to the lower end of an upwardly extending pull rod 21 having an upper end securely attached to a wall 22. The wall 22 is formed intermediate the ends of a cylinder 23 having a closed upper end and an open lower end.

The upper portion of the cylinder 23 between the closed upper end and the wall 22 defines a gas spring chamber 24 which is separated from an upper fluid chamber 25 by means of an elastomeric bladder 26. The bladder 26 includes an annular sealing ring (not shown) formed on the lower end thereof which is suitably sealed to the inner side walls of the cylinder 23. A passageway 27 is formed in the wall 22 and provides a fluid path between the upper fluid chamber 25 and a lower fluid chamber 28.

The gas spring chamber 24 is typically charged with an inert gas such as nitrogen, for example. The spring force can be adjusted to an optimum for any given well by simply charging the chamber 24 to different pressures.

The gas spring chamber 24 is designed to minimize any leakage of gas from the chambers. The elastomeric bladder 26 is utilized to minimize the diffusion rate of the gas into the associated fluid. Also, because the gas in the chamber 24 is surrounded by a fluid at equal pressure, the lack of pressure differential across the bladder 26 militates against the escape of gas from the chamber. Furthermore, the gas chamber 24 is designed as an inverted cup-like structure so as to trap the gas even if the bladder 26 were to rupture.

A charge valve 29 provides selective fluid communication between the interior of the tubing string 13 and the fluid chambers 25 and 28. As will be discussed, the charge valve 29 functions to recharge the upper and lower fluid chambers 25 and 28 on each pumping cycle.

The pump chamber assembly 16 includes a spring piston 31 formed on the upper end thereof which is slidably mounted within the lower portion of the cylinder 23. The lower portion of the cylinder 23 between the wall 22 and the spring piston 31 defines the variable volume lower fluid chamber 28. A piston chamber 32 is located in the lower end of the pump chamber assembly 16 for slidably receiving the piston 19. An aperture 33 is formed in the upper end of the chamber 32 for slidably receiving the pull rod 21.

A traveling check valve 34 is positioned in the piston 19 and provides selective fluid communication between the portion of the piston chamber 32 below the piston 19 and a pump cavity 35. The pump cavity 35 is the volume defined by the upper portion of the piston chamber 32 and the top surface of the piston 19. A pair of standing check valves 36 and 37 are positioned at the top of the piston chamber 32 and provide selective fluid communication between the pump cavity 35 and the interior of the tubing string 13.

The reciprocating motion of the spring assembly 18 forces fluid in the lower end of the piston chamber 32 to be transported upward into the tubing string 13. On the downstroke of the spring assembly, the standing check valves 36 and 37 are closed and the traveling check valve 34 is opened such that the fluid below the piston 19 flows through the traveling check valve 34 into the pump cavity 35. On the upstroke of the spring assembly 18, the traveling check valve 34 is closed and the standing check valves 36 and 37 are opened such that fluid in the pump cavity 35 flows through the check valves 36 and 37 into the tubing string 13.

One important advantage of the subsurface pump 11 according to the present invention is that no significant compression forces are applied to the pull rod 21 during the operation of the pump. Therefore, the rod 21 can be longer than the rods in other subsurface pumps for an increased stroke and pumping capacity. During the down stroke, the fluid flows through the traveling valve 34 and the passageway 27 to offer little resistance to the piston 19 and the wall 22 respectively. During the up stroke, the gas in the spring chamber 24 exerts pressure on the fluid in the chamber 25 and 28 resulting in a net upward force on the wall 22 placing the rod 21 in tension.

It should be noted that the subsurface pump 11 is comparatively insensitive to gas locking as a result of the location of the standing valves. Since the standing valves are positioned at the top of the pump cavity 35, any gas which is introduced into the pump cavity will be released on the up stroke of the piston 19. Thus, the subsurface pump 11 can be used in wells having a relatively high gas-liquid ratio.

The surface unit 12 includes a surface pump 38 for cyclically applying pressure to the fluid in the tubing string 13 to actuate the subsurface pump 11. The surface pump 38 includes a surface piston assembly 39 having a piston 41 slidably mounted within a piston chamber 42. The piston 41 includes a tubular piston rod 43 extending through the upper wall of the piston chamber. A helical compression spring 44 is located within the piston rod 43. The spring 44 exerts an upward force on a cam follower support 45, which is slidably positioned in the piston rod and includes a cam follower 46 rotatably mounted thereon.

The spring 44 is a force limiting spring which permits the system to automatically compensate for changes in fluid compressibility and specific gravity. The fluid received from the well W is not a homogeneous mixture, and typically includes changing mixtures of water, gas and oil, each having a different specific gravity and compressibility. These changing mixtures require different pressures and displacements from the surface piston assembly 39 in order to supply a consistent amount of energy to the subsurface pump 11. The spring 44 provides a means for achieving variable displacement from the surface piston assembly 39 which is large enough for the maximum expected fluid compressibility, while protecting the system from excessive pressures.

A cam 47 and a flywheel 48 are attached together for rotation about a common axis. The cam 47 and the flywheel 48 are rotatably mounted on a support arm 49 such that the cam follower 46 engages the cam 47.

The cam 47 permits the displacement of the piston assembly 39 to be controlled as a function of time. The cam 47 can be designed to compensate for changes in flywheel rotation rates or, in a continuous rotation flywheel system, to provide different compression and expansion cycles. Also, in some instances it may be desirous to provide a dwell at the minimum system pressure to permit production delivery without displacement of the surface piston assembly.

An electric motor 51 is connected to a source of electric power (not shown) and includes drive means which engages the flywheel 48 for resupplying energy to the system. The motor 51 can be either an A.C. or D.C. type which runs continuously or is controlled so that only the required amount of energy is added to the system.

An outlet port 52 is formed in the side wall of the surface pump piston chamber 42. The location of the port 52 in the chamber 42 is such that fluid can flow from the chamber 42 into the port 52 only when the piston assembly 39 is in the top portion of its stroke and the fluid pressure is near the minimum. A back pressure valve 53 is connected between the outlet port 52 and a production line 54. The valve 53 maintains the fluid in the system at a selected minimum pressure. Typically, the minimum pressure is selected to be above the vapor pressure of the fluid in the tubing string 13 to minimize the formation of gas in the fluid. Free gas bubbles within the tubing string 13 can cause significant volume displacement changes and unrecoverable thermodynamic losses. Thus, if the fluid pressure is maintained above the fluid vapor pressure, gas formation can be avoided.

OPERATION

FIG. 1 illustrates the portion of the pumping cycle wherein pressure is exerted on the fluid in the tubing string 13 to actuate the subsurface pump 11. As shown in FIG. 1, the cam 47 of the surface unit 12 is rotated counterclockwise to urge the cam follower 46 and the support 45 downwardly to compress the spring 44. The spring 44 exerts a downward force on the piston assembly to downwardly displace the piston assembly 39 and compress the fluid within the surface pump piston chamber 42 and the tubing string 13.

The fluid pressure in the tubing string produces a resultant downward force on the spring assembly 18. When the resultant downward force of the fluid pressure exceeds the upward force generated on the assembly 18 by the gas in the gas chamber 24, the assembly 18 is displaced downwardly. This lowers the piston 19 within the chamber 32 to draw fluid through the traveling check valve 34 and into the pump cavity 35. On the downward stroke of the piston 19, the standing check valves 36 and 37 remain closed to prevent fluid in the tubing string 13 from entering the pump cavity 35.

As the assembly 18 is forced downwardly, the volume of the lower fluid chamber 28 decreases to cause fluid in the chamber 28 to flow through passageway 27 into the upper fluid chamber 25. The volume of the fluid chamber 25 is increased and the volume of the gas chamber 24 is decreased to compress the gas within the chamber 24.

When the cam 47 has rotated such that the high point of the cam 47 engages the cam follower 46, the surface piston assembly 39 is at its lowermost position and the fluid in the tubing string is at its maximum pressure. At this time, the spring assembly 18 is also at its lowermost position, as shown in FIG. 2, such that the pump cavity 35 is filled with fluid from the production zone at a maximum volume.

In order to compensate for any fluid leakage from the lower fluid chamber 28 into the tubing string 13, the charge valve 29 permits fluid in the tubing string to flow into the fluid chambers 24 and 28 such that the fluid pressure in the chambers 24 and 28 becomes equal to the fluid pressure in the tubing string, which is at a maximum at this point. Thus, the charge valve 29 provides a means of insuring that the gas in the chamber 24 is fully compressed on each pumping cycle. As will be discussed, the charge valve is a very important feature of the present invention since it eliminates the need of providing complicated sealing means between the spring piston 31 and the inner side walls of the cylinder 23.

When the high point of the cam 47 engages the cam follower 46, the rotational velocity of the flywheel 48 is at a minimum, while the compression forces of the pressurized fluid in the tubing string 13 are at a maximum. The compression forces create a "ballooning" effect of the tubing string 13 to store potential energy in the tubing string 13, which energy is at a maximum at this point.

As the cam 47 and the flywheel 48 continue to rotate, the fluid in the tubing string expands and the tubing string contracts. This generates an upward force on the surface piston assembly 39 which causes the cam follower to accelerate the cam 47 and the flywheel 48. Hence, the potential energy stored in the tubing string 13 is transformed into kinetic energy stored in the rotating flywheel 48. This kinetic energy can be utilized to pressurize the tubing string 13 on the next pumping cycle.

As shown in FIG. 3, when the fluid pressure in the tubing string 13 acting upon the cylinder 23 falls below a predetermined value, the pressurized gas in the chamber 24 expands and forces the fluid in the upper fluid chamber 25 through the passageway 27 into the lower fluid chamber 28. This results in an upward tension force on the pull rod 21 which displaces the piston 19 upwardly such that fluid in the pump cavity 35 flows through the standing valves 36 and 37 into the tubing string 13. The upward displacement of the piston 19 also draws fluid from within the well casing 14 into the piston chamber 32.

It should be noted that during the up stroke of the spring assembly 18, there can be fluid leakage from the lower fluid chamber 28 into the tubing string 13 between the outer annular surface of the spring piston 31 and the inner side walls of the cylinder 23. However, as previously mentioned, the charge valve 29 will insure that the fluid is replaced and the pressure in the upper and lower chambers 24 and 28 is brought up to the maximum fluid pressure on the next pumping cycle.

When the surface piston assembly 39 is displaced to its uppermost position, the fluid in the pump chamber 42 flows through the port 52 and the valve 53 into the production line 54. At this time, the tubing string 13 is in a state of minimum potential energy, while the flywheel 48 is in a state of maximum kinetic energy.

In summary, as the flywheel 48 and the cam 47 rotate, the surface piston assembly applies pressure to the fluid in the tubing string 13 to actuate the subsurface pump 11 and to store potential energy in the tubing string during a portion of each revolution, and converts potential energy released from the tubing string into kinetic energy stored in the flywheel during another portion of each revolution.

The invention concerns a fluid actuated pump which can be utilized in a pumping system having a means for cyclically applying pressure fluid to the pump. The pump includes a means responsive to the cyclic application of pressure fluid for drawing fluid from a source and means for actuating the means for drawing fluid to discharge the fluid to a conduit. The means for actuating can include a cylinder, means for dividing the interior of the cylinder into a gas filled chamber and a fluid filled chamber, means responsive to the cyclic application of the pressure fluid for moving the means for dividing to increase the volume of the fluid filled chamber and decrease the volume of the gas filled chamber thereby compressing the gas, and means for permitting the flow of the pressure fluid into the fluid filled chamber.

In the preferred embodiment, the cylinder receives and is movable with respect to a stationary piston. The means for dividing is an elastomeric bladder and the means for actuating includes a second fluid filled chamber defined in the cylinder between the piston and a wall. The second fluid filled chamber is in fluid communication with the first fluid filled chamber. The pressure fluid moves the cylinder to decrease the volume of the second fluid filled chamber which forces fluid into the first fluid filled chamber moving the bladder and compressing the gas. Alternating with the applications of pressure fluid, the gas expands forcing fluid from the first to the second fluid filled chamber moving the cylinder in the opposite direction. The cylinder actuates the means for drawing fluid from a source.

Although the subsurface pump apparatus has been found to have particular utility when utilized with a cyclical surface pumping unit which stores, converts and re-uses energy, it should be understood that the apparatus may also be utilized with other pressure-applying sources, such as high pressure pipe lines or wells with suitable valving, or conventional pumping means, and the like, in numerous end uses.

Although the invention has been described in terms of specified embodiments which are set forth in detail, it should be understood that this is by illustration only that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In an apparatus for pumping fluid from a source through a conduit, including pump means connected to the conduit and responsive to the cyclic application and withdrawal of pressure to the fluid in the conduit for pumping fluid from the source into the conduit, the pump means comprising: piston means for pumping the fluid and responsive to the application of pressure to the fluid in the conduit for moving in a first direction; gas spring means for moving said piston means in the opposite direction when said pressure is removed from the fluid in the conduit; a fluid filled chamber defined by a cylinder closed at one end by said piston means and at another end by said gas spring means and in fluid communication between said piston means and said gas spring means; and means for connecting said chamber to the conduit to replace any fluid lost from said chamber during the operation of said piston means.

2. The apparatus of claim 1 wherein said means for connecting includes a charge valve for fluid flow only from the tubing string to said fluid filled chamber when the pressure applied to the fluid in the conduit exceeds the fluid pressure in said chamber.

3. In an apparatus for pumping fluid from a source through a conduit, including pump means connected to the conduit and responsive to the cylic application and withdrawal of pressure to the fluid in the conduit for pumping fluid from the source into the conduit, and means for cyclically applying and withdrawing pressure to the fluid in the conduit to actuate the pump means, the pump means comprising: piston means for pumping the fluid and responsive to the application of pressure to the fluid in the conduit for moving in a first direction; gas spring means for moving said piston means in the opposite direction when said pressure is removed from the fluid in the conduit; a fluid filled chamber defined by a cylinder closed at one end by said piston means and at another end by said gas spring means and in fluid communication between said piston means and said gas spring means; and means for connecting said chamber to the conduit to replace any fluid lost from said chamber during the operation of said piston means.

4. The apparatus of claim 3 wherein said means for connecting includes a charge valve for fluid flow only from the conduit to said fluid filled chamber when the pressure applied to the fluid in the conduit exceeds the fluid pressure in said chamber.

5. In an apparatus for pumping fluid from a subterranean well through a tubing string, including pump means connected to the tubing string and responsive to the cyclic application and withdrawal of pressure to the fluid in the tubing string for pumping fluid from the well into the tubing string, the pump means comprising: piston means for pumping the fluid and responsive to the application of pressure to the fluid in the tubing string for moving in a first direction; gas spring means for moving said piston means in the opposite direction when said pressure is removed from the fluid in the tubing string; a fluid filled chamber defined by a cylinder closed at one end by said piston means and at another end by said gas spring means and in fluid communication between said piston means and said gas spring means; and means for connecting said chamber to the tubing string to replace any fluid lost from said chamber during the operation of said piston means.

6. The apparatus of claim 5 wherein said means for connecting includes a charge valve for fluid flow only from the tubing string to said fluid filled chamber when the pressure applied to the fluid in the tubing string exceeds the fluid pressure in said chamber.

7. In an apparatus for pumping fluid from a subterranean well through a tubing string, including pump means connected to the tubing string and responsive to the cyclic application and withdrawl of pressure to the fluid in the tubing string for pumping fluid from the well into the tubing string, and means for cyclically applying and withdrawing pressure to the fluid in the tubing string to actuate the pump means, the pump means comprising: piston means for pumping the fluid and responsive to the application of pressure to the fluid in the tubing string for moving in a first direction; gas spring means for moving said piston means in the opposite direction when said pressure is removed from the fluid in the tubing string; a fluid filled chamber defined by a cylinder closed at one end by said piston means and at another end by said gas spring means and in fluid communication between said piston means and said gas spring means; and means for connecting said chamber to the tubing string to replace any fluid lost from said chamber during the operation of said piston means.

8. The apparatus of claim 7 wherein said means for connecting includes a charge valve for fluid flow only from the tubing string to said fluid filled chamber when the pressure applied to the fluid in the tubing string exceeds the fluid pressure in said chamber.

9. In an apparatus for pumping fluid from a source through a conduit, including pump means connected to the conduit and responsive to the cyclic application and withdrawal of pressure to the fluid in the conduit for pumping fluid from the source into the conduit, the pump means comprising: a piston chamber connected between the source and the conduit; a piston slidably movable in the piston chamber for pumping the fluid through said piston chamber; an elongated rod connected at one end to said piston; spring means connected to the other end of said rod for placing said rod in tension and moving said piston in a direction to discharge fluid from said piston chamber to the tubing string; and means attached to said other end of said rod for equalizing the forces applied to said rod as said piston is moved in the opposite direction by the application of pressure to the fluid in the conduit.

10. The apparatus of claim 9 wherein said means for equalizing includes a cylinder attached to the other end of said rod, said cylinder having a fluid filled upper chamber above the other end of said rod and a fluid filled lower chamber below the other end of said rod, said chambers being connected by a passageway fluid flow from said lower chamber to said upper chamber to apply equal and opposite forces to the other end of said rod.

11. In an apparatus for pumping fluid from a source through a conduit, including pump means connected to the conduit and responsive to the cyclic application and withdrawal of pressure to the fluid in the conduit for pumping fluid from the source into the conduit, and means for cyclically applying and withdrawing pressure to the fluid in the conduit to activate the pump means, the pump means comprising: a piston chamber connected between the source and the conduit; a piston slidably movable in said piston chamber for pumping the fluid through said piston chamber; an elongated rod connected at one end to said piston; spring means connected to the other end of said rod for placing said rod in tension and moving said piston in a direction to discharge fluid from said piston chamber to the conduit; and means attached to said other end of said rod for equalizing the forces applied to said rod as said piston is moved in the opposite direction by the application of pressure to the fluid in the conduit.

12. The apparatus of claim 11 wherein said means for equalizing includes a cylinder attached to the other end of said rod, said cylinder having a fluid filled upper chamber above the other end of said rod and a fluid filled lower chamber below the other end of said rod, said chambers being connected by a passageway fluid flow from said lower chamber to said upper chamber to apply equal and opposite forces to the other end of said rod.

13. In an apparatus for pumping fluid from a subterranean well through a tubing string, including pump means connected to the tubing string and responsive to the cyclic application and withdrawal of pressure to the fluid in the tubing string for pumping fluid from the well into the tubing string, the pump means comprising: a piston chamber connected between the well and the tubing string; a piston slidably movable in said piston chamber for pumping the fluid through said piston chamber; an elongated rod connected at one end to said piston; spring means connected to the other end of said rod for placing said rod in tension and moving said piston in a direction to discharge fluid from said piston chamber to the tubing string: and means attached to said other end of said rod for equalizing the forces applied to said rod as said piston is moved in the opposite direction by the application of pressure to the fluid in the tubing string.

14. The apparatus of claim 13 wherein said means for equalizing includes a cylinder attached to the other end of said rod, said cylinder having a fluid filled upper chamber above the other end of said rod and a fluid filled lower chamber below the lower end of said rod, said chambers being connected by a passageway fluid flow from said lower chamber to said upper chamber to apply equal and opposite forces to the other end of said rod.

15. In an apparatus for pumping fluid from a subterranean well through a tubing string, including pump means connected to the tubing string and responsive to the cyclic application and withdrawal of pressure to the fluid in the tubing string for pumping fluid from the well into the tubing string and means for cyclically applying and withdrawing pressure to the fluid in the tubing string to activate the pump means, the pump means comprising: a piston chamber connected between the well and the tubing string; a piston slidably movable in said piston chamber for pumping the fluid through said piston chamber; an elongated rod connected at one end to said piston; spring means connected to the other end of said rod for placing said rod in tension and moving said piston in a direction to discharge fluid from said piston chamber to the tubing string; and means attached to said other end of said rod for equalizing the forces applied to said rod as said piston is moved in the opposite direction by the application of pressure to the fluid in the tubing string.

16. The apparatus of claim 15 wherein said means for equalizing includes a cylinder attached to the other end of said rod, said cylinder having a fluid filled upper chamber above the other end of said rod and a fluid filled lower chamber below the other end of said rod, said chambers being connected by a passageway fluid flow from said lower chamber to said upper chamber to apply equal and opposite forces to the other end of said rod.

17. In an apparatus for pumping fluid from a source through a conduit, including pump means connected to the tubing string and responsive to the cyclic application and withdrawal of pressure to fluid in the conduit for pumping fluid from the source into the conduit, the pump means including pumping means reciprocally movable between first and second positions for pumping the fluid and being responsive to the application of pressure to the fluid in the conduit for moving to the first position and spring means for moving the pumping means to the second position when the pressure is removed, the spring means comprising: a cylinder connected to the pumping means and defining a gas filled chamber and a fluid filled chamber separated by a bladder; a piston slidably engaging said cylinder in said fluid filled chamber as said cylinder moves with said pumping means; and means for connecting said fluid filled chamber with the conduit for replacing fluid leaking between said piston and said cylinder.

18. The apparatus of claim 17 wherein said cylinder and said piston form a metal-to-metal seal.

19. The apparatus of claim 17 wherein means for connecting includes a check valve for fluid flow only from the tubing string to said fluid filled chamber when the pressure applied to the fluid in the tubing string exceeds the fluid pressure in said fluid filled chamber.

20. In an apparatus for pumping fluid from a source through a conduit, including pump means connected to the conduit and responsive to the cyclic application and withdrawal of pressure to the fluid in the conduit for pumping fluid from the source into the conduit, and means for cyclically applying and withdrawing pressure to the fluid in the conduit to activate the pump means, the pump means including pumping means reciprocally movable between first and second positions for pumping the fluid and being responsive to the application of pressure to the fluid in the conduit for moving to the first position and spring means for moving the pumping means to the second position when the pressure is removed, the spring means comprising: a cylinder connected to the pumping means and defining a gas filled chamber and a fluid filled chamber separated by a bladder; a piston slidably engaging said cylinder in said fluid filled chamber as said cylinder moves with said pumping means; and means for connecting said fluid filled chamber with the conduit for replacing fluid leaking between said piston and said cylinder.

21. The apparatus of claim 20 wherein said cylinder and said piston form a metal-to-metal seal.

22. The apparatus of claim 20 wherein said means for connecting includes a check valve for fluid flow only from the conduit to said fluid filled chamber when the pressure applied to the fluid in the conduit exceeds the fluid pressure to said fluid filled chamber.

23. In an apparatus for pumping fluid from a subterranean well through a tubing string, including pump means connected to the tubing string and responsive to the cyclic application and withdrawal of pressure to the fluid in the tubing string for pumping fluid from the well into the tubing string, the pump means including pumping means reciprocally movable between first and second positions for pumping the fluid and being responsive to the application of pressure to the fluid in the tubing string for moving to the first position and spring means for moving the pumping means to the second position when the pressure is removed, the spring means comprising: a cylinder connected to the pumping means and defining a gas filled chamber and a fluid filled chamber separated by a bladder; a piston slidably engaging said cylinder in said fluid filled chamber as said cylinder moves with said pumping means; and means for connecting said fluid filled chamber with the tubing string for replacing fluid leaking between said piston and said cylinder.

24. The apparatus of claim 23 wherein said cylinder and said piston form a metal-to-metal seal.

25. The apparatus of claim 23 wherein said means for connecting includes a check valve for fluid flow only from the tubing string to said fluid filled chamber when the pressure applied to the fluid in the tubing string exceeds the fluid pressure in said fluid filled chamber.

26. In an apparatus for pumping fluid from a subterranean well through a tubing string, including pump means connected to the tubing string and responsive to the cyclic application and withdrawal of pressure to the fluid in the tubing string for pumping fluid from the well into the tubing string, and means for cyclically applying and withdrawing pressure to the fluid in the tubing string to activate the pump means, the pump means including pumping means reciprocally movable between first and second positions for pumping the fluid and being responsive to the application of pressure to the fluid in the tubing string for moving to the first position and spring means for moving the pumping means to the second position when the pressure is removed, the spring means comprising: a cylinder connected to the pumping means and defining a gas filled chamber and a fluid filled chamber separated by a bladder; a piston slidably engaging said cylinder in said fluid filled chamber as said cylinder moves with said pumping means; and means for connecting said fluid filled chamber with the tubing string for replacing fluid leaking between said piston and said cylinder.

27. The apparatus of claim 26 wherein said cylinder and said piston form a metal-to-metal seal.

28. The apparatus of claim 26 wherein said means for connecting includes a check valve for fluid flow only from the tubing string to said fluid filled chamber when the pressure applied to the fluid in the tubing string exceeds the fluid pressure in said fluid filled chamber.

* * * * *